United States Patent [19]

Schulman et al.

[11] 3,979,557

[45] Sept. 7, 1976

[54] SPEECH PROCESSOR SYSTEM FOR PITCH PERIOD EXTRACTION USING PREDICTION FILTERS

[75] Inventors: Richard J. Schulman, Englishtown; Mark J. Schneider, Nutley, both of N.J.

[73] Assignee: International Telephone and Telegraph Corporation, Nutley, N.J.

[22] Filed: July 3, 1975

[21] Appl. No.: 593,138

Related U.S. Application Data

[63] Continuation-in-part of Ser. No. 485,487, July 3, 1974, abandoned.

[52] U.S. Cl. ..... 179/1 SA

[51] Int. Cl.[2] ..... G10L 1/00

[58] Field of Search ..... 179/1 SA

[56] References Cited

UNITED STATES PATENTS

| | | | |
|---|---|---|---|
| 3,624,302 | 11/1971 | Atal | 179/1 SA |
| 3,740,476 | 6/1973 | Atal | 179/1 SA |

*Primary Examiner*—Kathleen H. Claffy
*Assistant Examiner*—E. Matt Kemeny
*Attorney, Agent, or Firm*—John T. O'Halloran; Alfred C. Hill

[57] ABSTRACT

A computational algorithm and an implementation thereof is described herein for determining the pitch period of voiced speech in real time. All processing is performed in the time domain employing the prediction residual or error signal of a 10th-order Itakura cascade adaptive linear predictor or filter as the input signal. The output (pitch period) of the algorithm and the implementation thereof is updated each sample period based on analysis of the present and past input samples. Pitch period is determined by locating the sharp pitch peaks in the short term power of the prediction residual. The instantaneous pitch period is the time separation of two adjacent pitch peaks. The algorithm and implementation thereof employs a time moving search window and a time varying threshold level to locate pitch peaks. Various tests and procedures are incorporated into the algorithm and the implementation thereof to handle the special cases of false and missed pitch peaks. Detected errors are corrected within the algorithm and the implementation thereof by utilizing past data. Unlike the correlation or averaging methods of pitch extraction which require large amounts of storage and arithmetic operations, the time domain method of this invention requires a minimal amount of storage and only simple comparisons of amplitudes.

12 Claims, 23 Drawing Figures

DECISION CIRCUIT
B YES
A NO
T
J-K TYPE FLIP FLOP
J T K R Q
D-TYPE FLIP FLOP
D T R Q
FULL ADDER
Ci B A Co W
EXCLUSIVE-OR GATE
NOT GATE
AND GATE
OR GATE
INHIBIT GATE
MULTIPLEXER
SHIFT REGISTER
SR T

INPUT FROM SQUARER 11
20
DIVIDER ÷16
(4) 32 BIT DELAY REGISTER
14
ADDER
15
(3) 32 BIT DELAY REGISTER
16
ADDER
17
(2) 32 BIT DELAY REGISTER
18
ADDER
19
DIVIDER ÷2
21
OUTPUT TO PITCH PERIOD ANALYZER

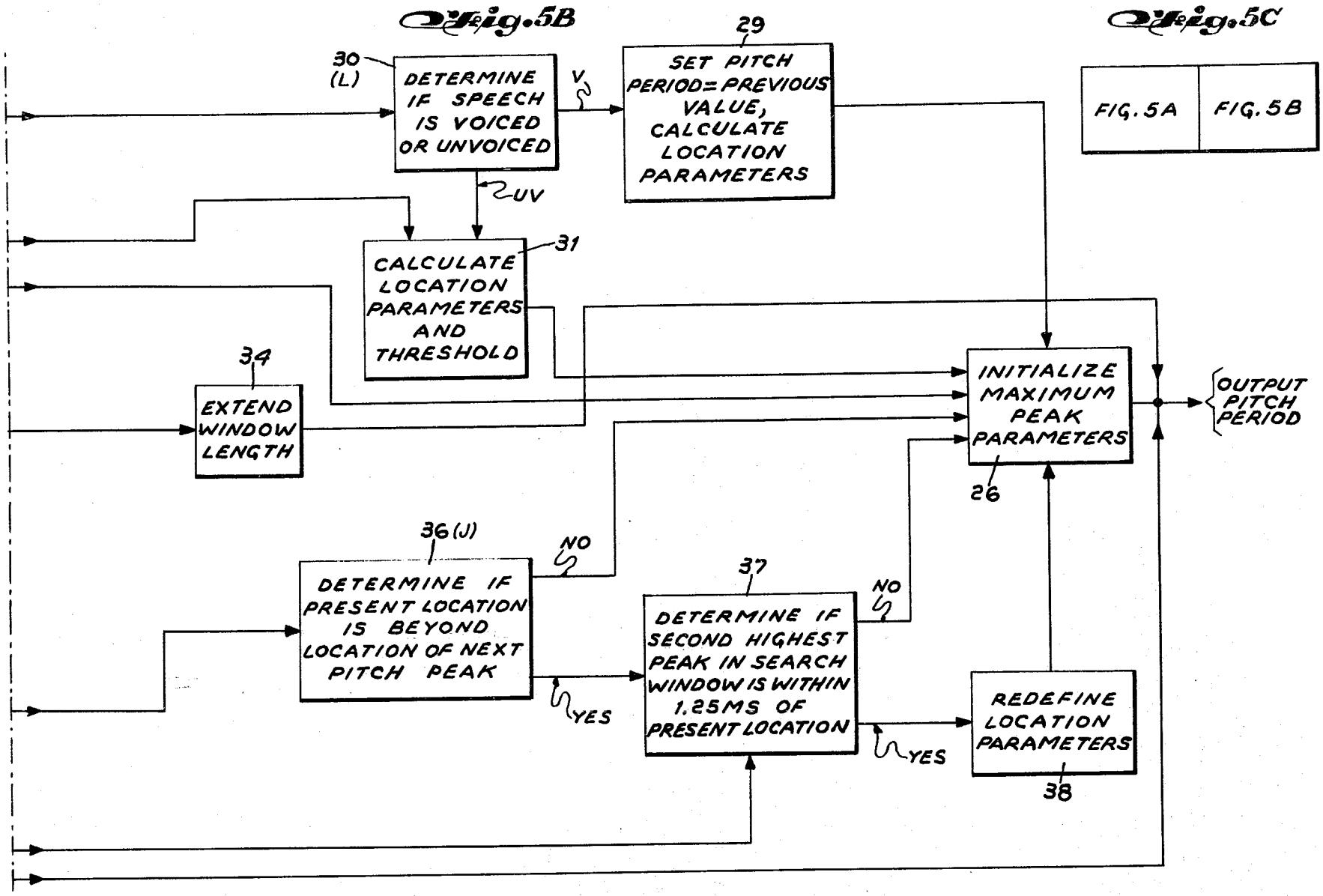
Fig. 5C
FIG. 5A
FIG. 5B
Fig. 5B
DETERMINE IF SPEECH IS VOICED OR UNVOICED
30 (L)
V
UV
SET PITCH PERIOD = PREVIOUS VALUE, CALCULATE LOCATION PARAMETERS
29
CALCULATE LOCATION PARAMETERS AND THRESHOLD
31
EXTEND WINDOW LENGTH
34
INITIALIZE MAXIMUM PEAK PARAMETERS
26
OUTPUT PITCH PERIOD
DETERMINE IF PRESENT LOCATION IS BEYOND LOCATION OF NEXT PITCH PEAK
36 (J)
NO
YES
DETERMINE IF SECOND HIGHEST PEAK IN SEARCH WINDOW IS WITHIN 1.25 MS OF PRESENT LOCATION
37
NO
YES
REDEFINE LOCATION PARAMETERS
38

Fig. 8A (SHIFT REGISTERS AND MULTIPLEXERS)
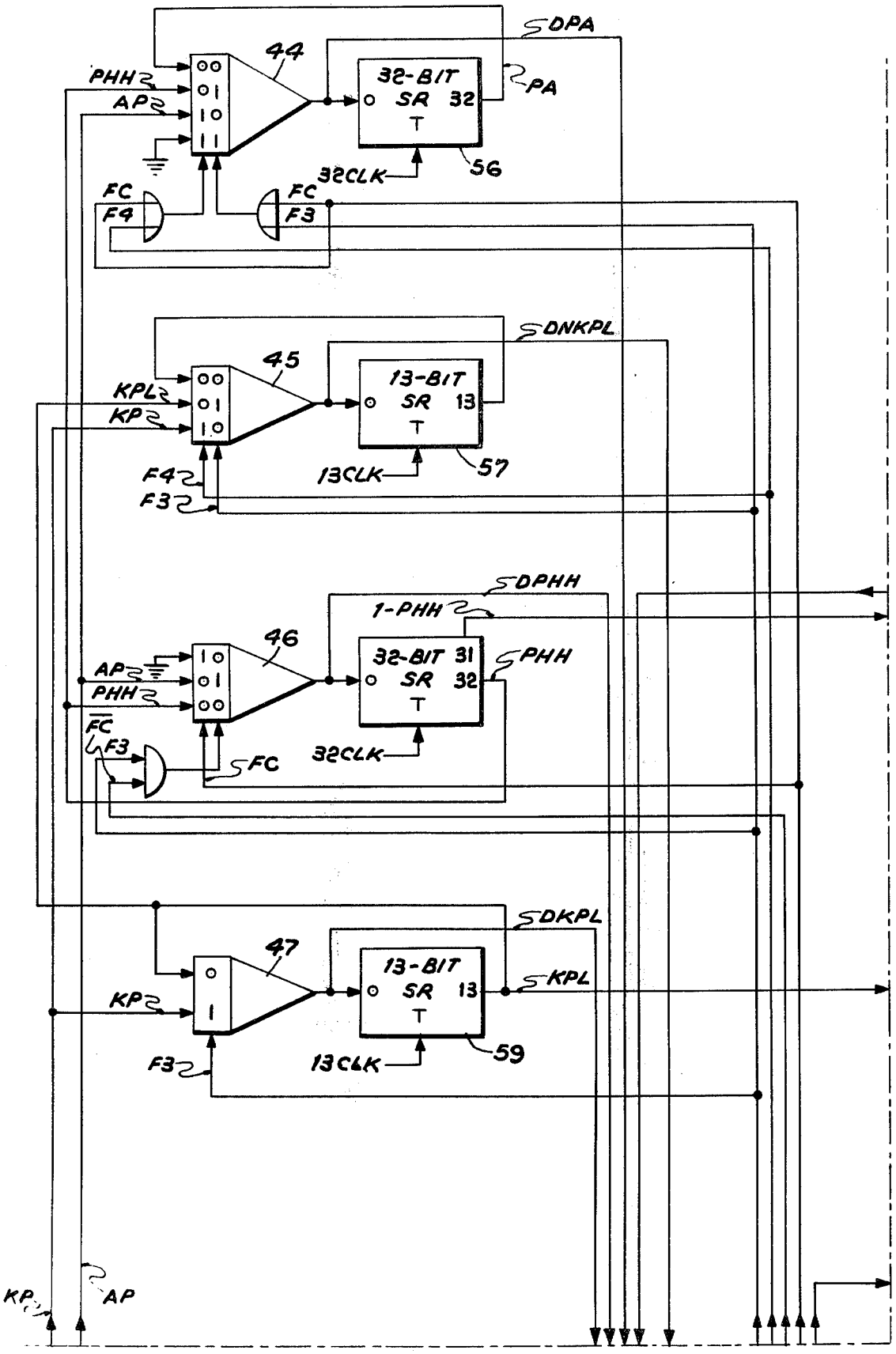

Fig. 8B (SHIFT REGISTER AND MULTIPLEXERS)
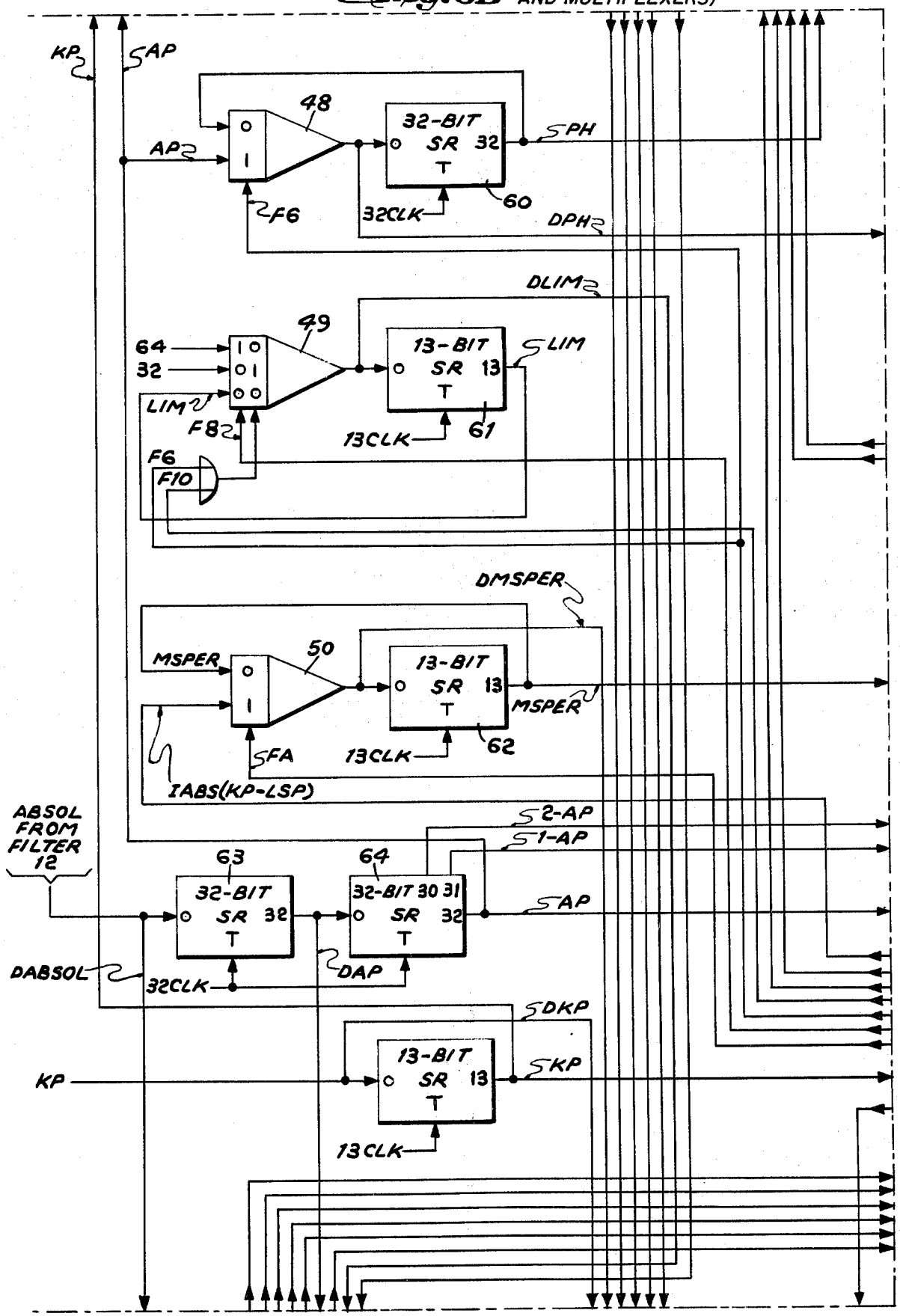

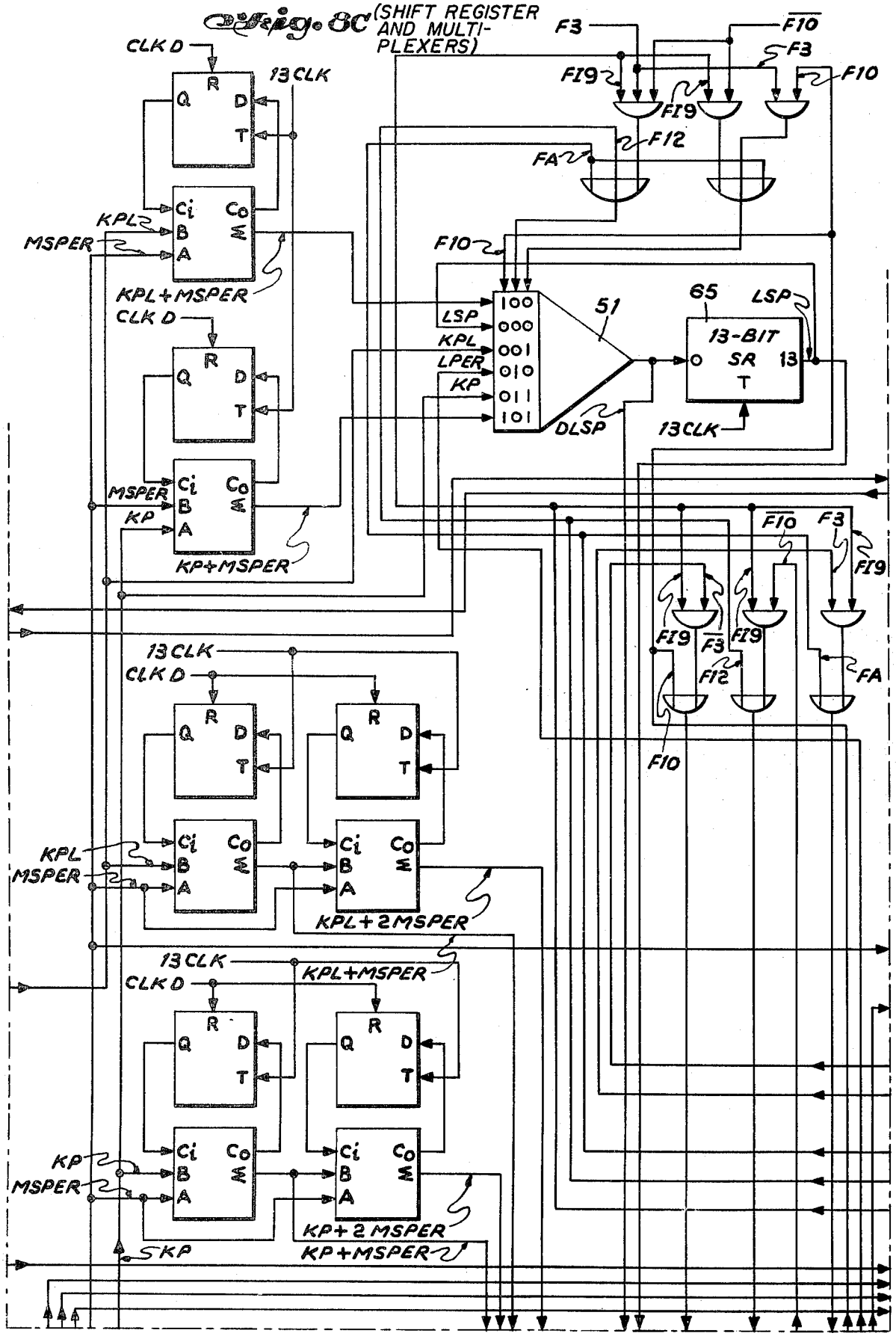
Fig. 8C (SHIFT REGISTER AND MULTI-PLEXERS)
CLK D
13 CLK
KPL
MSPER
KPL+MSPER
KP
KP+MSPER
KPL+2MSPER
KP+2MSPER
SKP
F3
F10
F19
F12
FA
LSP
LPER
DLSP
51
65
13-BIT SR
13

Fig. 8D (SHIFT REGISTER AND MULTIPLEXERS)
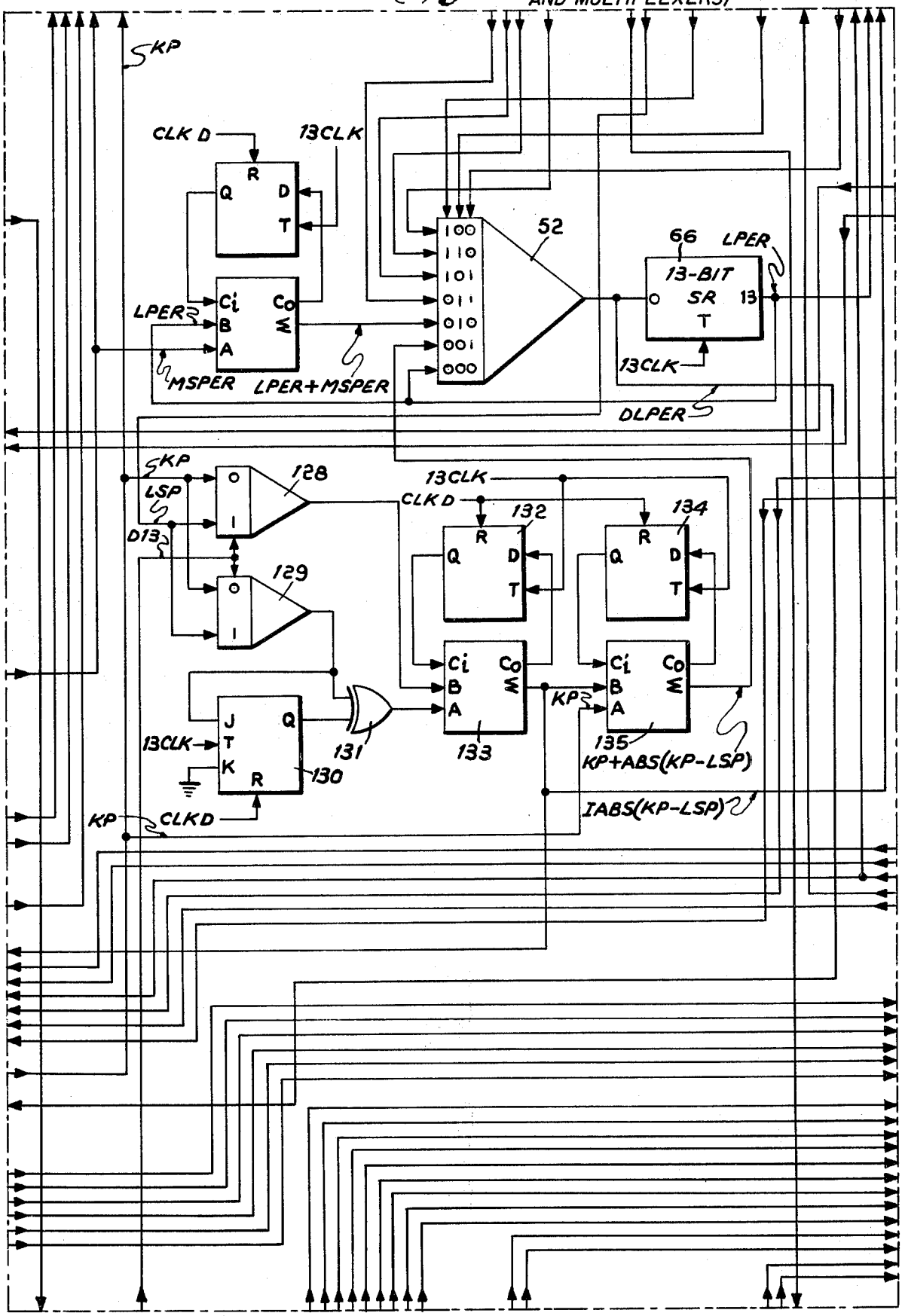

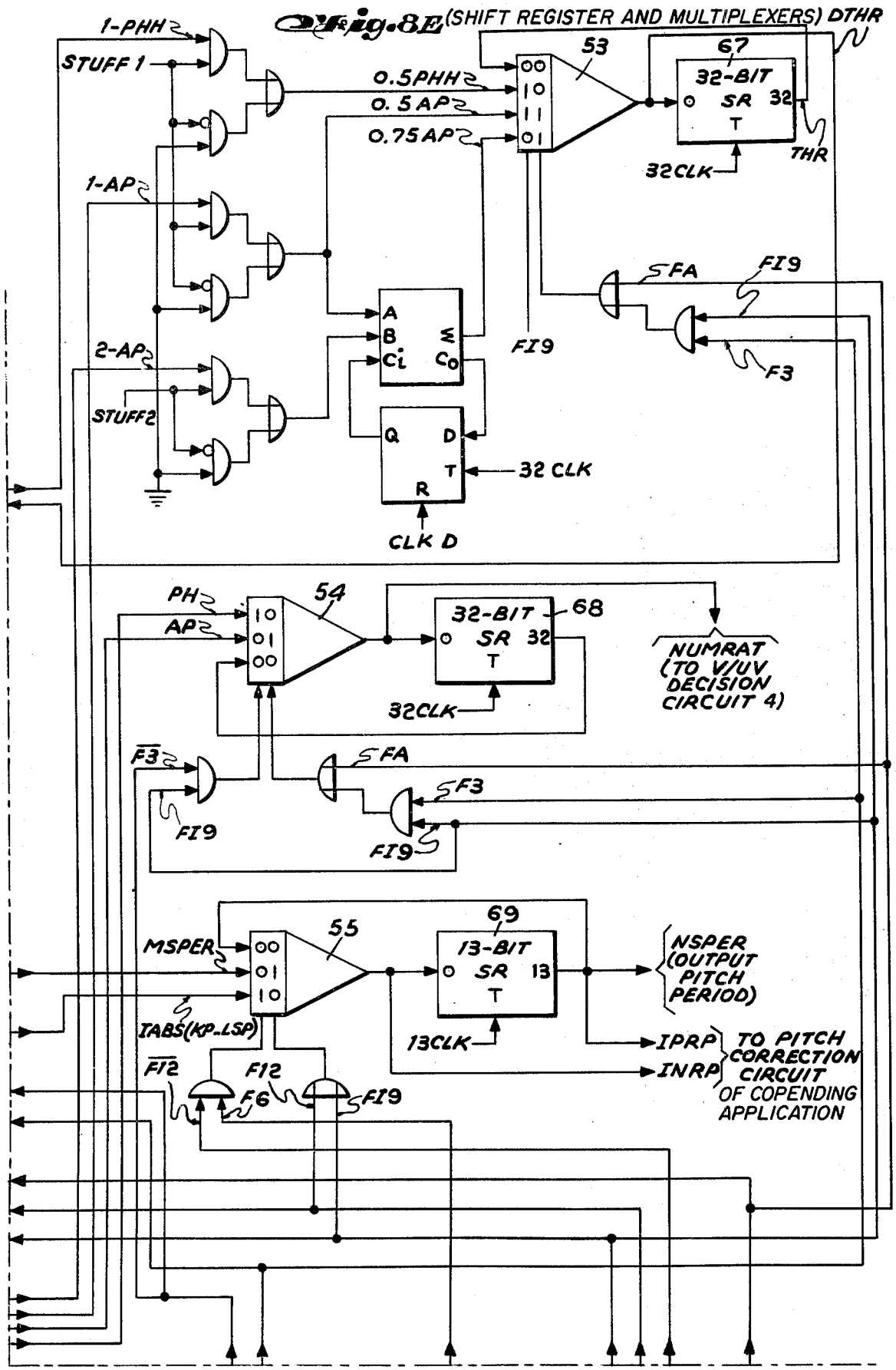
Fig. 8E (SHIFT REGISTER AND MULTIPLEXERS)
1-PHH
STUFF 1
1-AP
2-AP
STUFF2
0.5PHH
0.5AP
0.75AP
53
67
32-BIT
SR 32
T
32CLK
DTHR
THR
FA
FI9
F3
A
B
Ci
Co
Q
D
R
32 CLK
CLK D
PH
AP
54
68
NUMRAT (TO V/UV DECISION CIRCUIT 4)
F3
FI9
55
69
13-BIT
MSPER
TABS(KP-LSP)
13CLK
NSPER (OUTPUT PITCH PERIOD)
IPRP
INRP
TO PITCH CORRECTION CIRCUIT OF COPENDING APPLICATION
FI2
F12
F6

Fig. 8F (DECISION CIRCUITS)
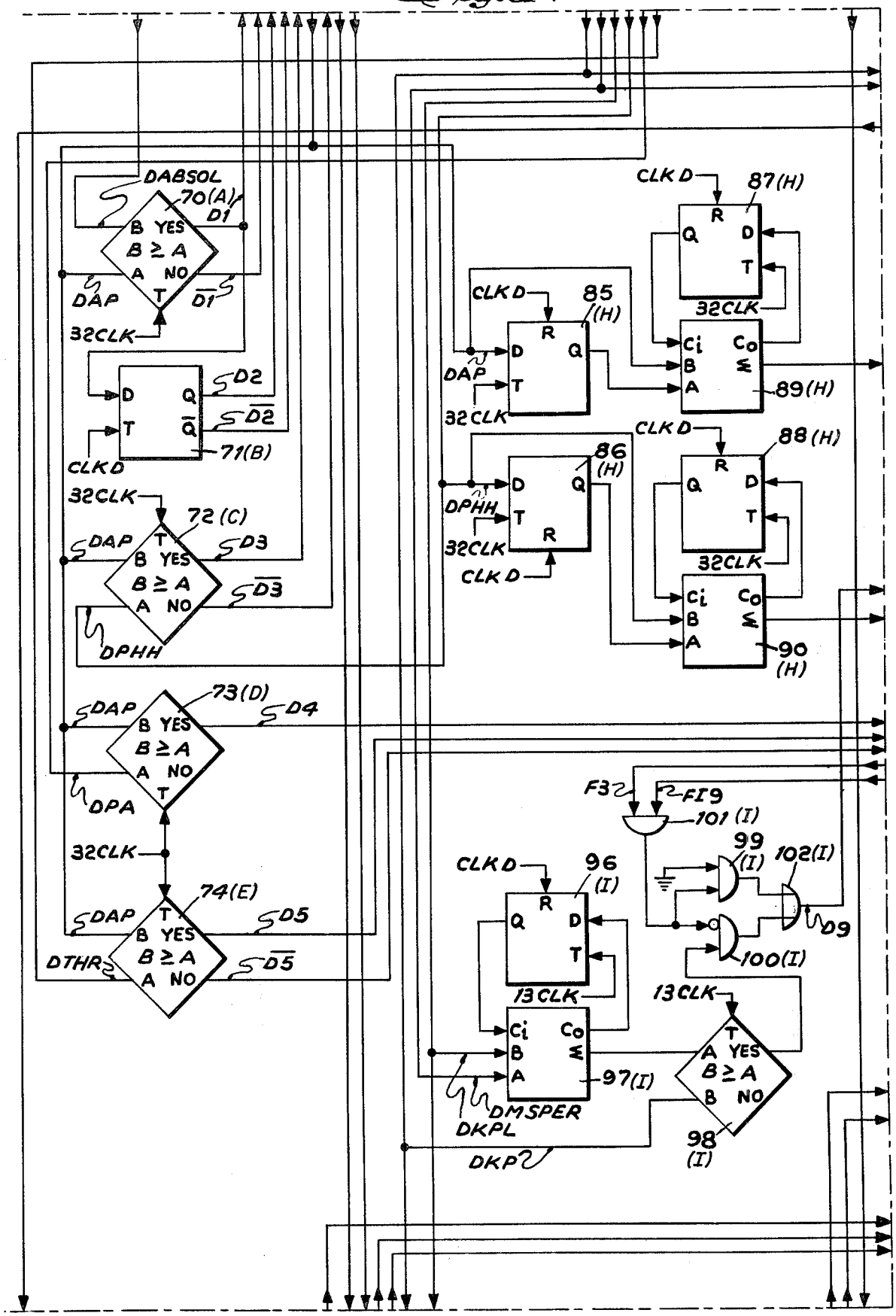

Fig. 8G (DECISION CIRCUITS)
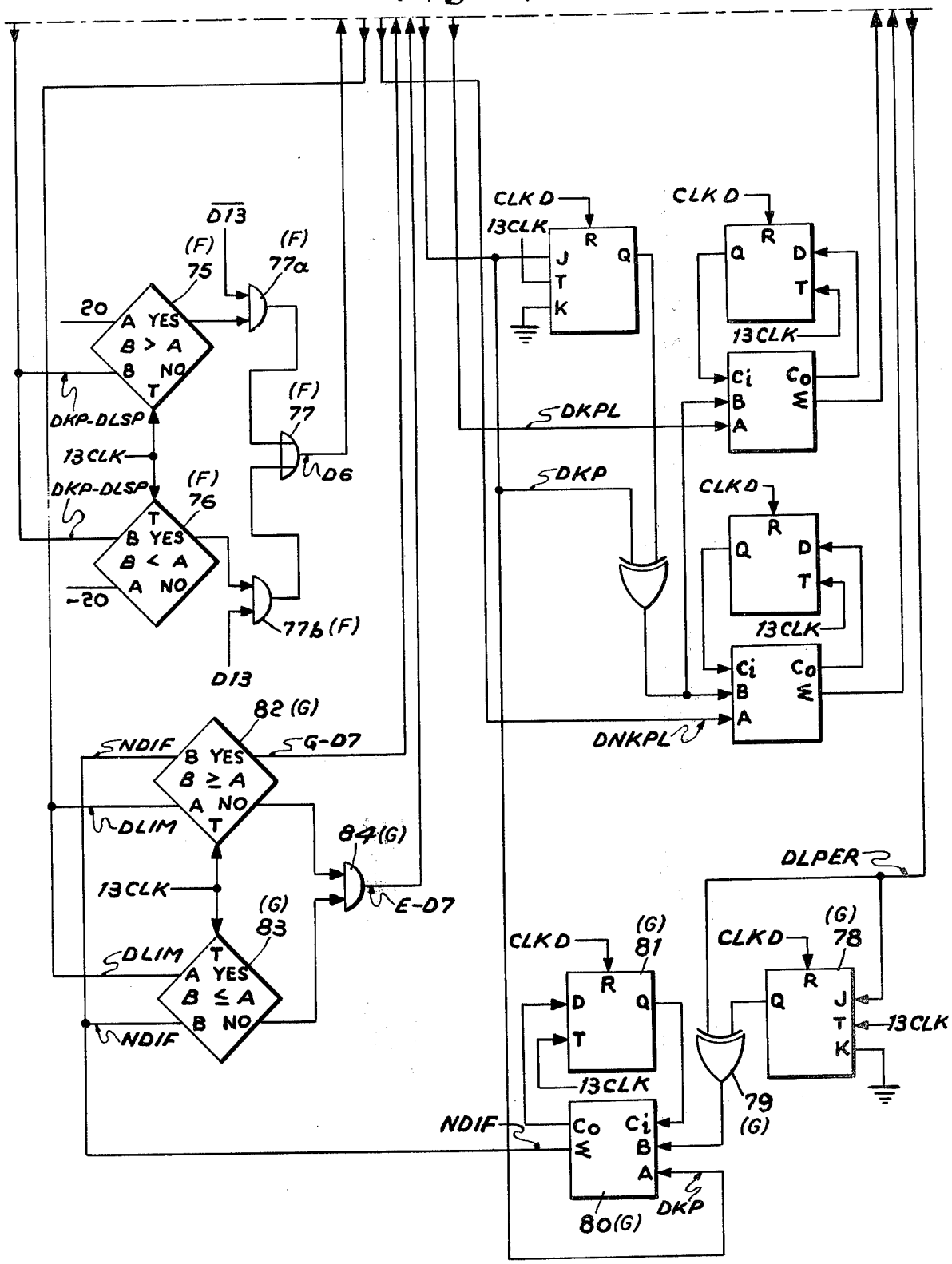

Fig. 8H (DECISION CIRCUITS
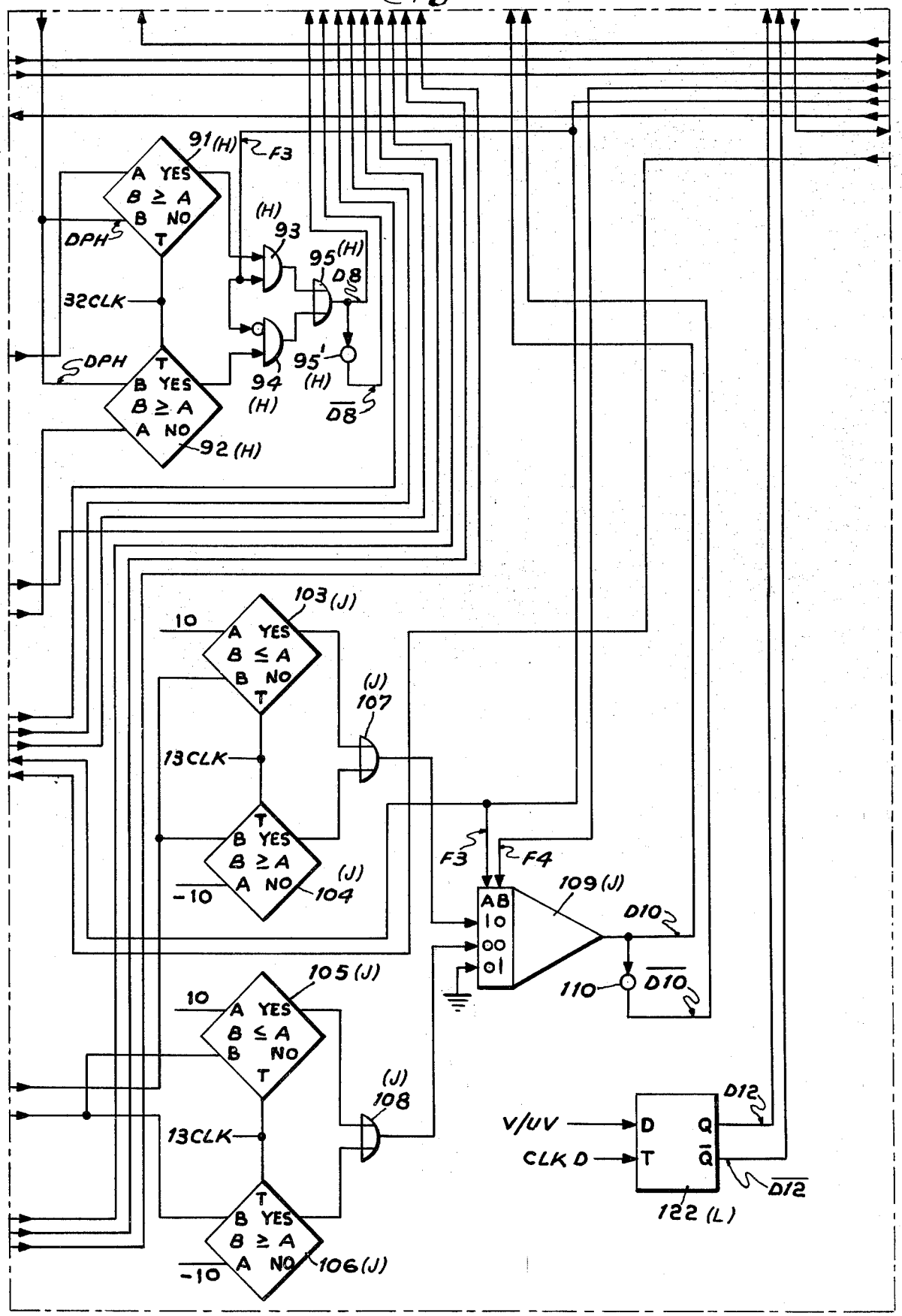

Fig. 8I (DECISION CIRCUITS)
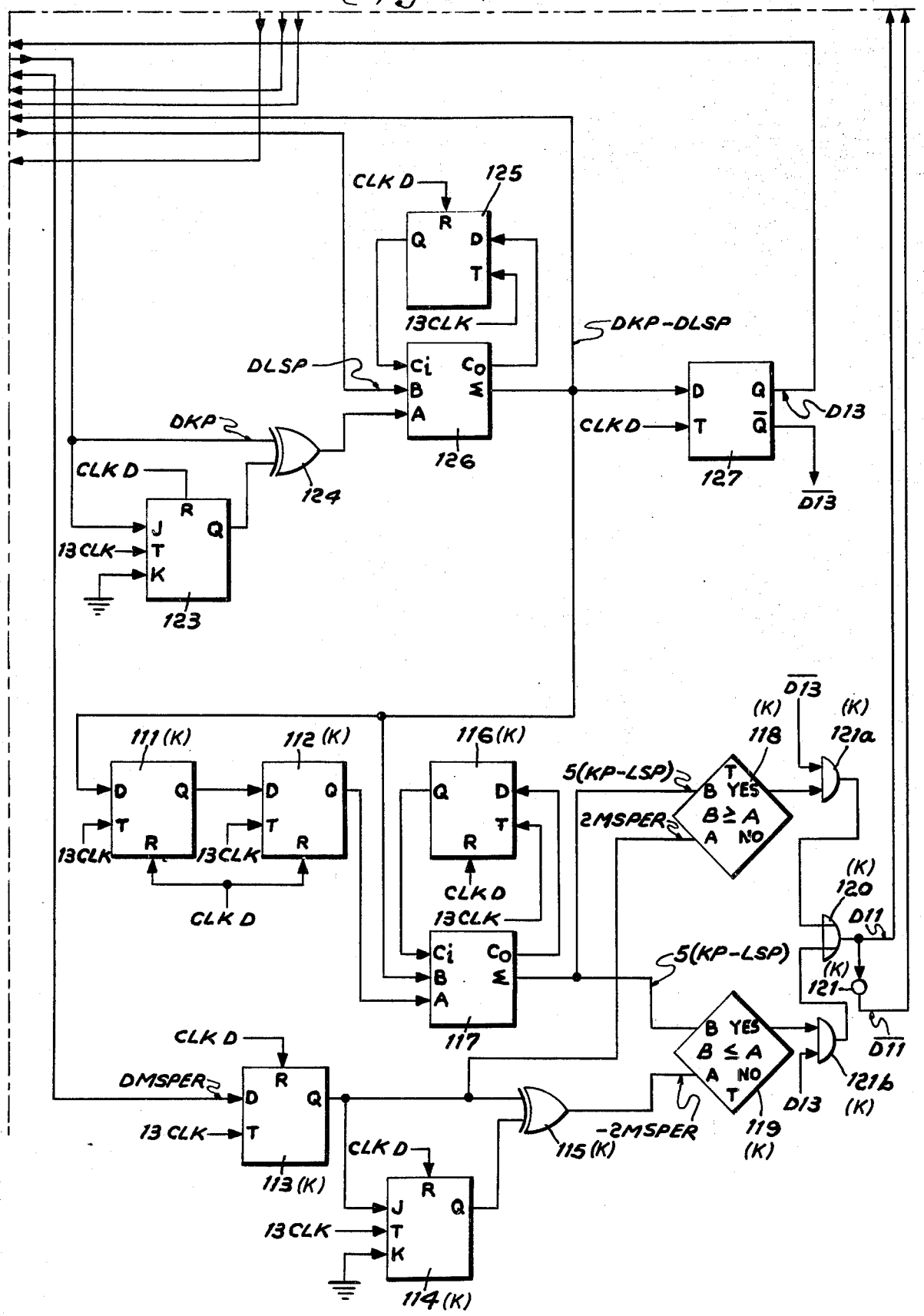

Fig. 8J (FLOW LOGIC)
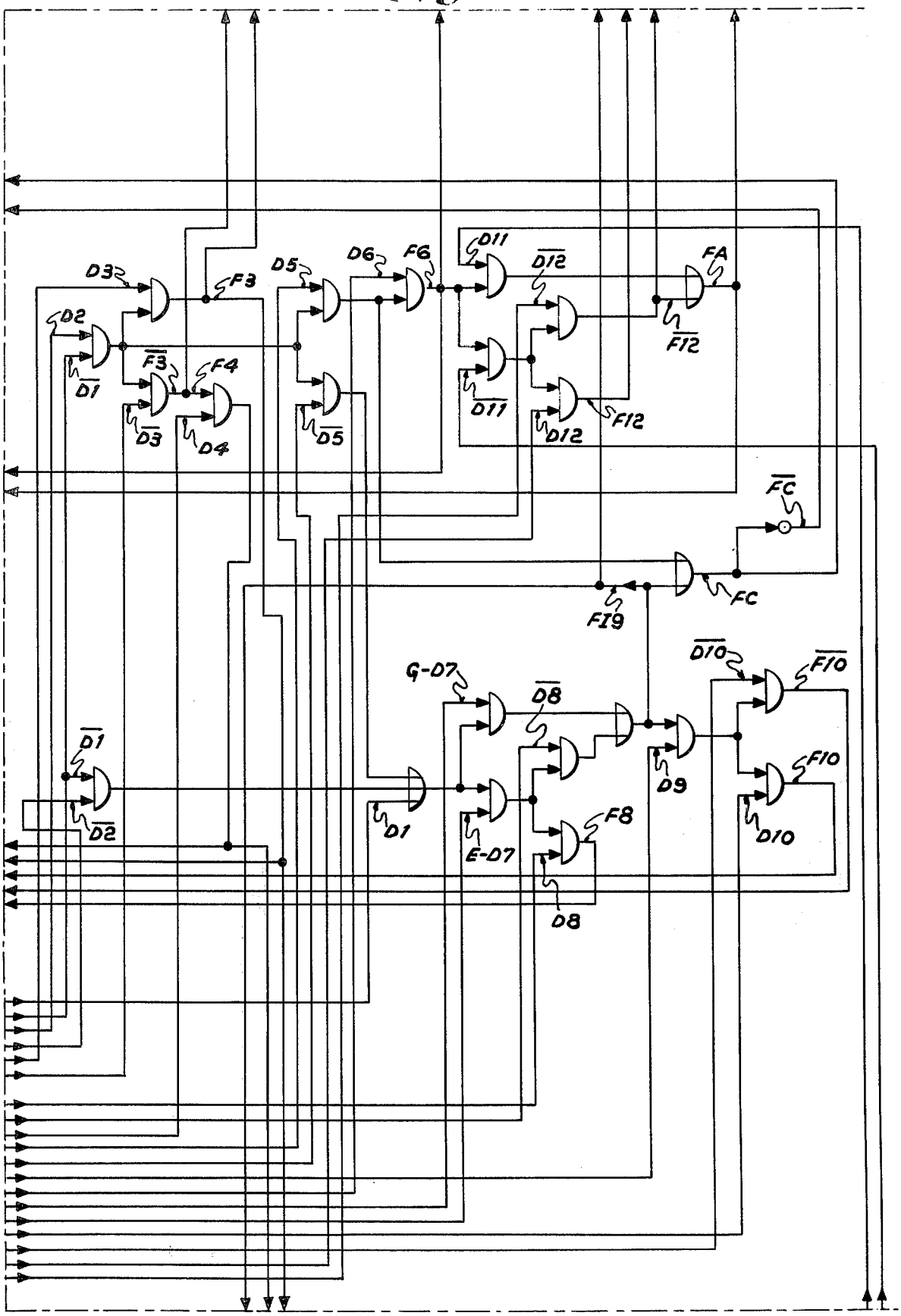

SPEECH PROCESSOR SYSTEM FOR PITCH PERIOD EXTRACTION USING PREDICTION FILTERS

CROSS REFERENCE TO RELATED APPLICATIONS

This is a continuation-in-part application of copending application Ser. No. 485,487, filed July 3, 1974, now abandoned.

BACKGROUND OF THE INVENTION

This invention relates to digital speech vocoders and more particularly to a pitch period extraction algorithm and an implementation to carry out the same for such vocoders.

One of the most difficult problems in vocoders is the reliable determination of the pitch period of voiced speech. A great deal of work has been done in this area in the past, resulting in many pitch extraction techniques. However, the basic operating principles of these many pitch period extraction schemes fall into one of the following three categories:

1. Direct analysis of a speech spectrum or a processed version of the spectrum, e.g. cepstrum.
2. Direct analysis of the time domain speech wave form or a processed version of the time speech wave form, e.g. filtering and cubing the speech.
3. Analysis of an averaging function obtained from the speech spectrum or time speech wave form, e.g. the auto-correlation function of the speech.

When approaching the task of devising and implementing a pitch extraction algorithm a major objective is to develop a system of good performance with a minimum of hardware complexity.

The method of achieving this objective is greatly influenced by the ultimate purpose of the device. In general, a pitch period extractor is used as part of a large system for speech analysis. When this is true, the most effective method of attaining this objective from a systems point of view is to try to utilize existing data from other parts of the system as an aid in accomplishing the task of pitch period extraction.

The pitch period algorithm and implementation of the same as described herein is part of a speech analysis system. The purpose of the system is to represent speech signals in terms of a small enough number of parameters so that digitized speech can be transmitted over a digital communication channel at transmission rates as low as 2400 bits per second with the ability to regenerate speaker recognizable speech at the speech synthesis or receiver portion of the system. Due to the processing performed in this system the available data makes the time domain approach to pitch period extraction far simpler than the other two methods mentioned hereinabove.

SUMMARY OF THE INVENTION

Therefore, an object of the present invention is to provide a pitch period extraction algorithm and an implementation thereof for operation in the time domain.

Another object of the present invention is to provide a pitch period extraction algorithm and implementation thereof for operation in a time domain on the prediction residual from an adaptive linear predictor or filter.

Still another object of the present invention is to provide a pitch period extraction algorithm and implementation thereof for operation in the time domain on the prediction residual from a 10th-order Itakura cascade adaptive linear predictor or filter.

A feature of the present invention is the provision of a digital pitch period extraction circuit for a digital vocoder having a digital adaptive filter providing a digital prediction residual, the extraction circuit comprising: a squarer coupled to the adaptive filter to square the residual; a digital low pass filter coupled to the squarer to low pass filter the squared residual; and a pitch period analyzer coupled to the low pass filter to locate sharp pitch peaks in the output signal of the low pass filter and to determine the time separation between two adjacent pitch peaks to provide therefrom an output signal equal to the pitch period, the analyzer having a time moving search window and time varying amplitude threshold level to locate the pitch peaks.

Another feature of the present invention it the provision of an algorithm for pitch period extraction in a digital vocoder having a digital adaptive filter providing a digital prediction residual comprising the steps of: squaring the prediction residual; low pass filtering the squared prediction residual; and analyzing the low pass filtered squared prediction residual to locate sharp pitch peaks therein and to determine the time separation between two adjacent pitch peaks to provide an output signal equal to the pitch period, the step of analyzing including varying in time a search window and varying in time an amplitude threshold level.

BRIEF DESCRIPTION OF THE DRAWING

Above-mentioned and other features and objects of this invention will become more apparent by reference to the following description taken in conjunction with the accompanying drawing, in which:

FIGS. 5A and 5B, when organized as illustrated in FIG. 5C, is a block diagram of the pitch period algorithm in accordance with the principles of the present invention;

DESCRIPTION OF THE PREFERRED EMBODIMENT

Figure 1:
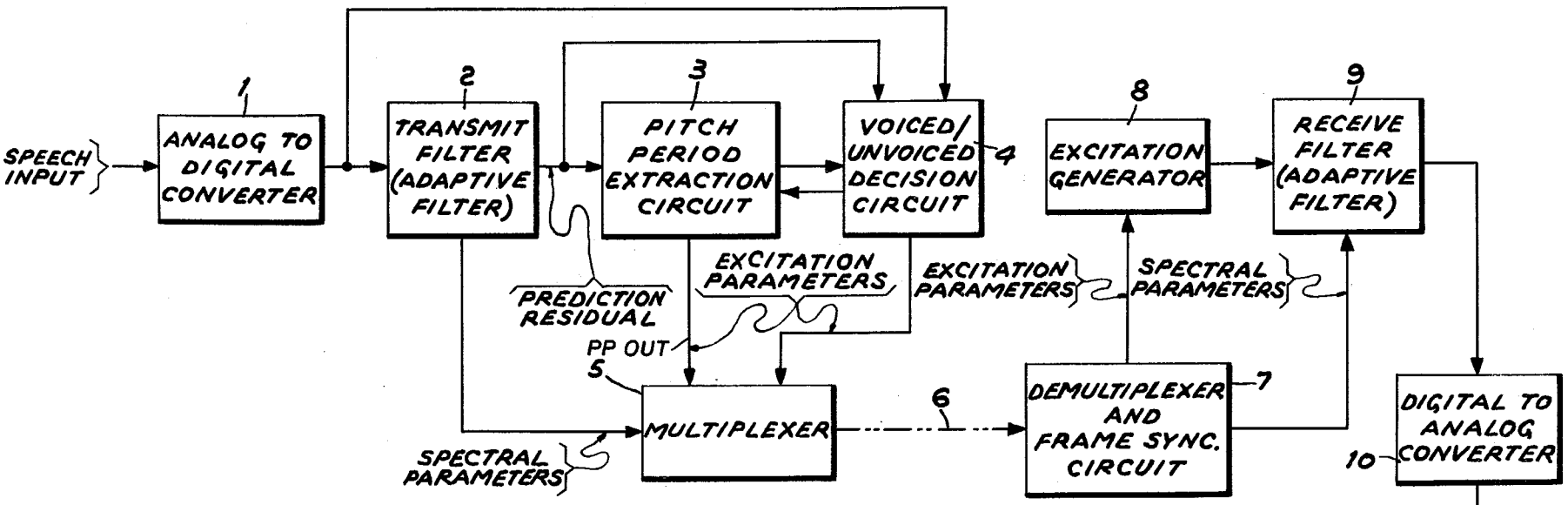
FIG. 1 is a simplified block diagram of a digital vocoder employing the pitch period algorithm and implementation thereof in accordance with the principles of the present invention.

FIG. 1 illustrates the basic block diagram of a digital vocoder incorporating a pitch period extraction circuit operating according to the algorithm of the present invention. Speech input to the transmitter or speech analyzer is sampled and converted to a digital representation in the analog to digital converter 1. Spectral parameters are derived from transmit filter 2 in the form of an adaptive filter and excitation parameter are derived from pitch period extraction circuit 3 and the voiced/unvoiced decision circuit 4. The spectrum parameter and excitation parameter are multiplexed in multiplexer 5 and transmitted to the receiver over transmission path 6. The transmited multiplexed signal is demultiplexed and the receiver is frame synchronized in demultiplexer and frame sync circit 7. The excitation parameter and spectrum parameter are coupled to excitation generator 8 and receive filter 9, respectively. Filter 9 is an adaptive filter having its transfer function inverse to the transfer function of transmit filter 2. The output of filter 9 is coupled to digital to analog converter 10 to reproduce the original speech input. All processing from converter 1 in the transmitter to converter 10 in the receiver is digital and implemented with logic circuits.

The basic block diagram of FIG. 1 is more completely disclosed, with the exception of the pitch period extraction circuit which is the subject matter of the present application, in the copending application of J. G. Dunn, J. P. Cowen and A. J. Russo, Ser. No. 505,808, filed Sept. 13, 1974, having the same assignee as the present invention, whose disclosure is incorporated herein by reference.

To be consistent with the other components of FIG. 1, the implementation of pitch period extraction circuit 3 which is described herein employs a hardware implementation using a multi-processing design with repetitive serial arithmetic units.

Figure 2:
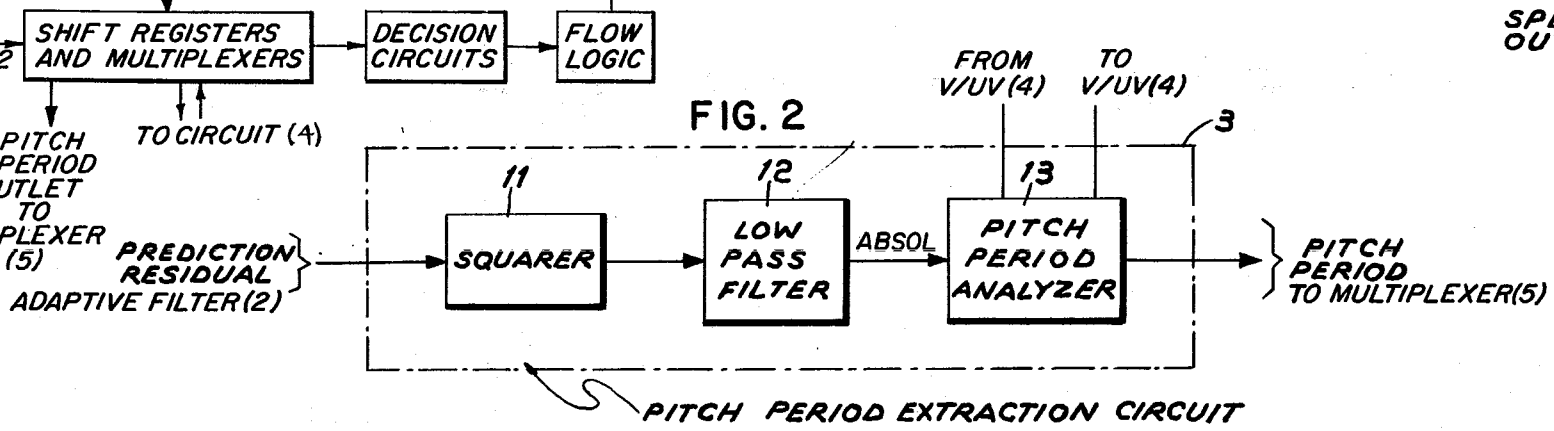
FIG. 2 is a block diagram of the pitch period extraction circuit of FIG. 1 utilizing the algorithm in accordance with the principles of the present invention.
Figure 9:
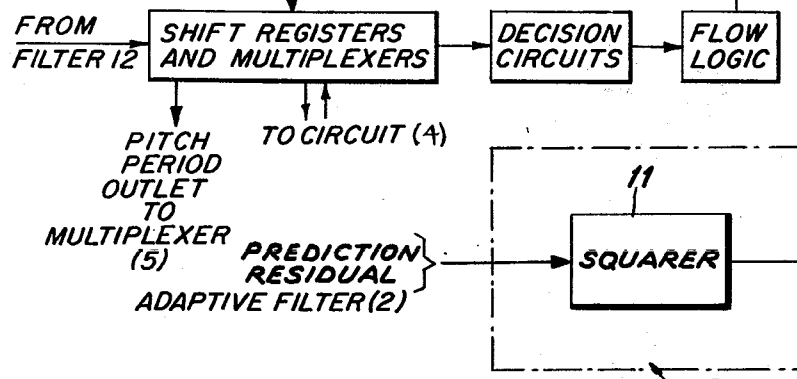
FIG. 9 is a functional block diagram of FIGS. 8A-8J.

Referring to FIG. 2, pitch period extraction circuit 3 basically includes a squarer 11 which multiplies the prediction residual at the output of filter 2 by itself and may take the form of the multiplier described with respect to FIG. 18 of the above-cited copending application. The output of squarer 11 is a 32-bit integer which is coupled to low pass filter 12 which is digital in nature and will be described hereinbelow with respect to FIG. 3. The low pass filter 12 obtains the frequency and impulse responses of the prediction residual. The output of low pass filter 12 is coupled to pitch period analzer 13 which operates in accordance with the algorithm described hereinbelow and is implemented as described hereinbelow. The output of analyzer 13 is the extracted pitch period.

To be consistent with the object of the above-cited copending application the adders and subtractors employed in connection with certain of the decision circuits of analyzer 13 are serial arithmetic units as fully disclosed in FIG. 17 of the above-cited copending application.

Figures 3, 6:
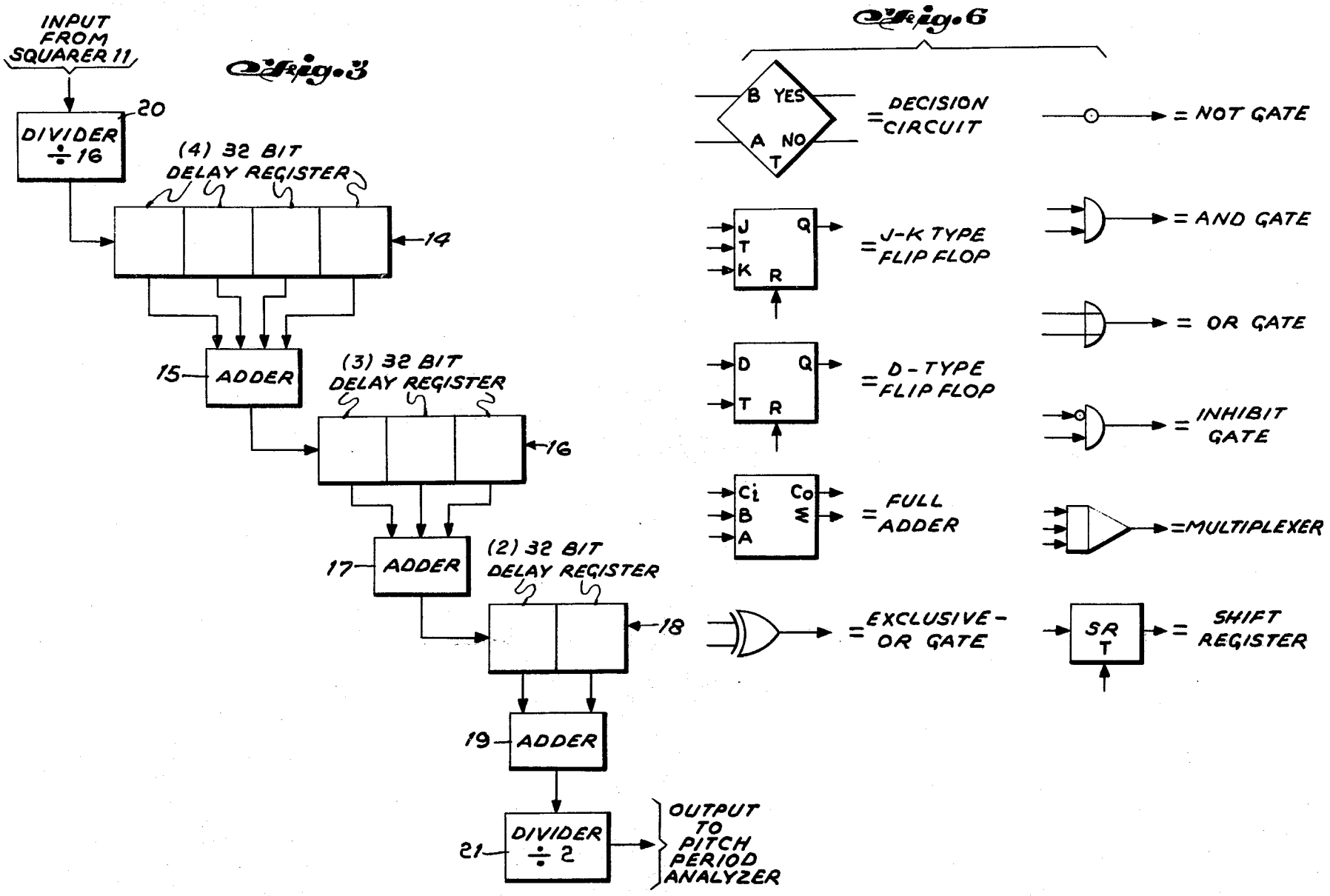
FIG. 3 is a block diagram of the low pass filter of FIG. 2.
FIG. 6 illustrates and defines logic symbols employed in FIGS. 7 and 8.

FIG. 3 illustrates the block diagram of low pass filter 12 of FIG. 2 and basically includes four 32-bit delay registers 14, an adder 15 is coupled to each of the four delay registers 14. The output of adder 15 is coupled to three 32-bit delay registers 16 with each of these registers having their outputs coupled to adder 17. The output of adder 17 is coupled to two 32-bit delay registers 18 whose outputs are coupled to adder 19. The digital low pass filter employed is relatively simple since registers and adders are the only components employed therein. The low pass filter as just described has an effective measured DC (direct current) gain of 24. To avoid overflows in registers 14, 16 and 18, the squared residual from squarer 11 is divided by sixteen in divider 20 prior to application to the first of delay registers 14. This reduces the effective number of bits for the squared residual to 28. In addition, the output of the filter, namely, the output of adder 19 is divided by two in divider 21 before application to pitch period analyzer 13 of FIG. 2. As a result, the overall measured DC filter gain is 0.75.

Figure 4A:
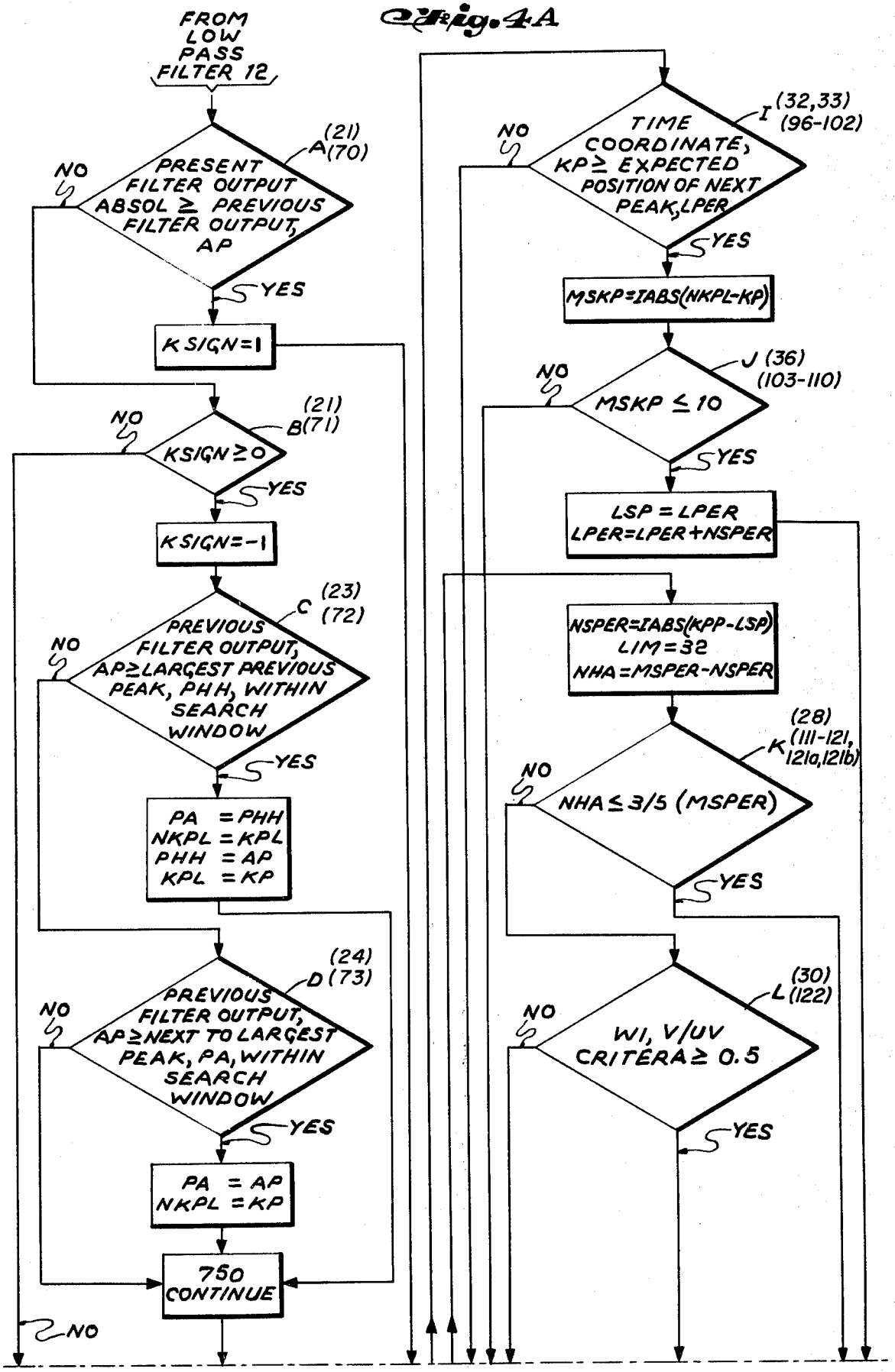
FIGS. 4A and 4B, when organized as illustrated in FIG. 4C, is the flow chart of the pitch period algorithm in accordance with the principles of the present invention.
Figures 4B, 4C:
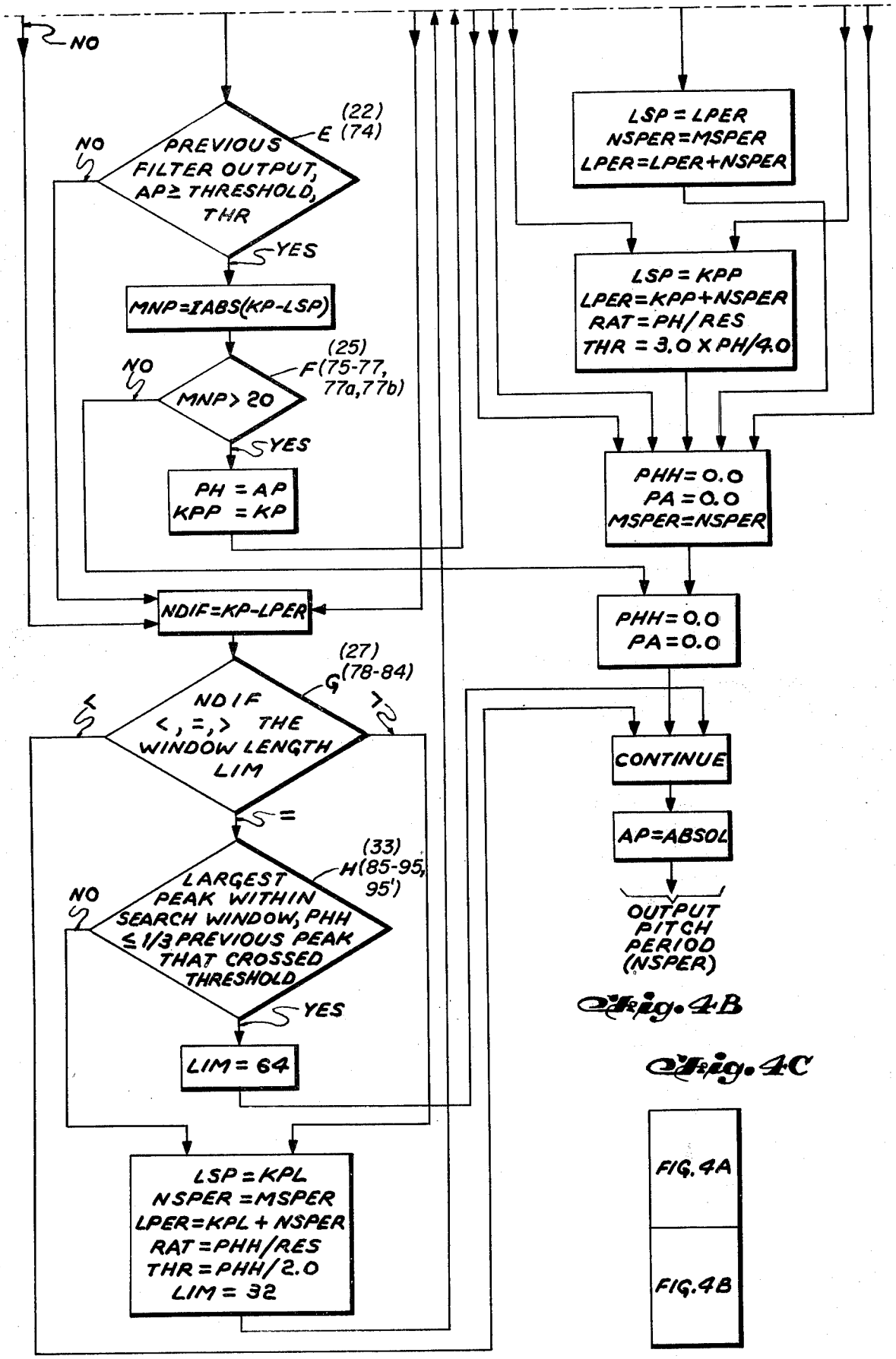

FIGS. 4A and 4B, when organized as illustrated in FIG. 4C, illustrates the flow chart of the pitch period extraction algorithm of the present invention which when taken with the following Table I of mnemonics will be self-explanatory and easily understood. The two sets of number reference characters in parentheses associated with the letter reference characters refer to the number reference characters of FIGS. 5A and 5B and the number reference characters of FIGS. 8F–8I with the lower reference character numbers referring to FIGS. 5A and 5B and the higher reference character numbers referring to FIGS. 8F–8I to enable a correlation of the blocks of FIGS. 5A and 5B and the components of FIGS. 8F–8I with the diamond-shaped blocks of FIGS. 4A and 4B.

TABLE I

| MNEMONIC | MEANING |
|---|---|
| KP | Time Coordinate |
| PA | Next to the highest peak amplitude within search window |
| NKPL | Position of next to the highest peak within search window |
| KPL | Position of largest peak in search window |
| LSP | Position of previous pitch peak |
| PH | Amplitude of latest pitch peak |
| KPP | Position of latest pitch peak |
| LPER | Assumed position of next pitch peak |
| LIM | Window width parameter |
| NSPER | Pitch period |
| MSPER | Previous pitch period |
| PHH | Amplitude of largest peak within the search window |
| ABSOL | Present filter output |
| AP | Previous filter output |
| KSIGN | Was last sample larger or smaller than previous sample |
| MSKP | LABS(NKPL-KP) |
| IABS | NSPER/(KPP-LSP) |
| NHA | MSPER-NSPER |
| THR | Threshold |
| MNP | IABS(KP-LSP) |
| NDIFF | KP-LPER |
| RAT | PH/RES |
| RES | Power of Prediction Residual |
| NUMRAT | INput to V/UV Decision Circuit |
| IPRP | Input to Pitch Corrections Circuit (Pitch Period from two samples ago) |
| INRP | Input to pitch correction circuit (pitch period from previous sample) |
| STUFF 1 | Stuff sign bits ("0") in MSB |
| STUFF 2 | Stuff two sign bits ("0") in MSB |

The above mnemonic table will also be helpful in following the operation of the logic diagram of FIGS. 8A–8J it being noted, however, that a prefix D before any of the above mnemonic means "connected to decision circuits."

Figure 5A:
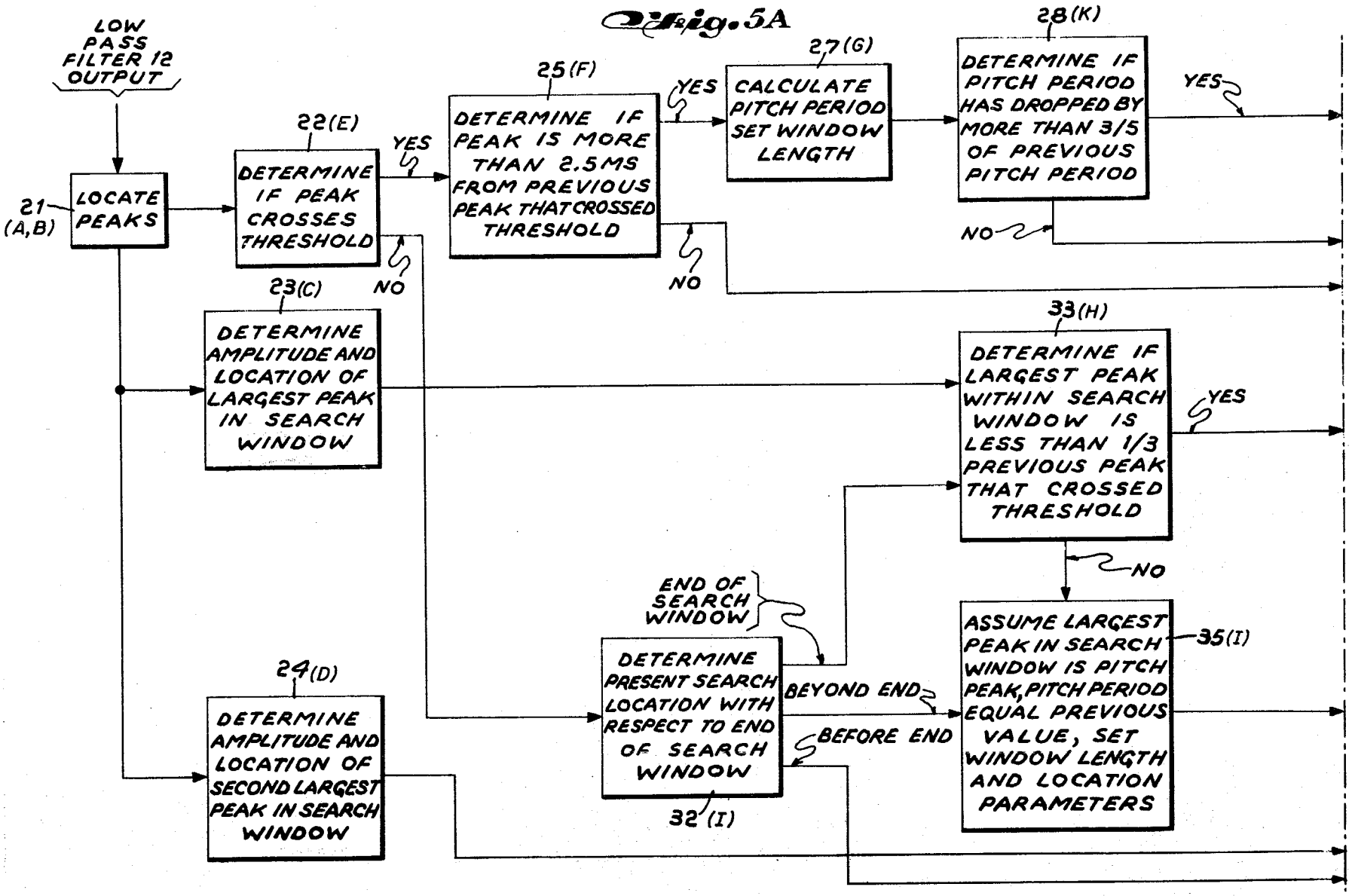

FIGS. 5A and 5B, when organized as illustrated in FIG. 5C, is a block diagram of the algorithm in accordance with the principles of the present invention and is another way of setting forth the decisions of the flow chart of FIGS. 4A and 4B that takes place in this algorithm to determine the pitch period. The legends in the blocks of this block diagram are believed to be self-explanatory so as to enable implementing the algorithm as set forth in either FIGS. 4A and 4B or FIGS. 5A and 5B. However, the following is a brief description of the operation of the algorithm when related to the block diagram of FIGS. 5A and 5B.

As previously mentioned, the pitch period extraction algorithm operates in the time domain on a processed version of the time speech wave form, namely, the prediction residual. As shown in FIG. 2 the algorithm and the implementation thereof can be broken down into three parts; a squarer 11, a low pass filter 12, and a pitch period analyzer 13. The input is the prediction residual output of the predictive adaptive filter because the periodic signal that occurs during voiced segments of speech is greatly enhanced in the prediction residual by operation of the adaptive filter. This is an example of using the existing signal in one part of the system to improve the performance of another part of the system.

To make the peaks of the prediction residual even more prominent and to reduce the noiselike characteristic of the signal in between peaks the prediction residual is squared and then low pass filtered. The filter has a 3 db (decibal) bandwidth of 750 Hz (hertz) with 40 db attenuation at 2000 Hz. This bandwidth was chosen because the pitch frequency of the human voice in general falls within the 0–750 Hz frequency range.

Using the output of the low pass filter 12, pitch analyzer 13 determines the pitch period by locating the position of the peaks and then calculating the distance between them. The output of the low pass filter 12 is scanned for peaks on a sample by sample basis as indicated in block 21. The algorithm processes the input whenever a peak is located by following one of two basic paths depending on whether the present peak crosses time varying threshold as indicated in block 22. The threshold level is set as a fraction of the amplitude of the previously located pitch peak in the last searh window. Within a search window the location and amplitude of the largest and second largest peak are continuously updated as each new peak is found as indicated by blocks 23 and 24.

When a peak is found that exceeds threshold, its distance from the previous pitch peak is noted. If the new peak occurs less than 2.5 milliseconds from the previous pitch peak that crossed the threshold, it is ignored since it is probably an extraneous peak and as indicated at block 25 the algorithm skips to the output circuit indicated in block 26 where the maximum peak parameters within the search window are initialized for a new search. When the peak is greater than 2.5 milliseconds away from the previous pitch peak, the present peak is assumed to be a pitch peak. The pitch period is then calculated by subtracting the location of the new pitch peak from the previous pitch peak. The window length was also derived in case it had changed during the search. These later two operations are indicated in block 27.

The new pitch period is compared to the value of the previous pitch period to see if it has dropped by more than 3/5 of the previous value as indicated in block 28. During a voiced period of speech a large change such as this would not normally occur, so that if the new period did take such a radical change it is assumed to be an error. A factor of 3/5 (slightly greater than 1/2) is used to allow the algorithm to correct double pitch period errors which require a 50% drop. Only large decreases in pitch periods are prevented because large increases are required for correct operation in the transition from unvoiced to voiced speech. If the pitch period is assumed incorrect, the new pitch period is set equal to the previous value rather than using the calculated period as indicated in block 29 after passing through block 30 which determines if the speech is voiced or unvoiced. A pitch peak is assumed to be located where the assumed period would have it fall and all other parameters are adjusted to fit this assumption in block 29. The parameters for locating maximum peaks are initialized for the next search cycle in block 26.

If the change in the calculated pitch period falls within the allowed range, or the large decrease falls during unvoiced speech, the pitch period is assumed correct. The assumed location of the next pitch peak is calculated by adding the pitch period to the location of the present pitch peak as indicated in block 31. This determines the location and width of the next search window. The threshold for the next search is calculated by taking 3/4 of the amplitude of the present pitch peak. The maximum peak parameters are then also initialized in block 26.

This describes one of the two main paths that the algorithm can follow. The other path is followed when the presently located peak does not exceed threshold. In this case, the first step after finding the peak does not exceed threshold is to determine the present search location with respect to the end of the search window as indicated in block 32. If the search has not reached the end of the search window all parameters are left unchanged and are coupled to block 26.

When the search has reached the end of the search window and no peaks have crossed threshold, a determination is made as to whether the correct pitch peak has been skipped because it would not exceed threshold. This is done by comparing the amplitude of the largest peak in the search window with the amplitude of the previous pitch peak as indicated in block 33. It is assumed that if the largest peak is less than 1/3 of the amplitude of the previous pitch peak the correct pitch peak has not yet been reached. Therefore, the search window length is extended as indicated in block 34, the results of which are coupled to block 26. All other parameters are left unchanged.

For the cases where the largest peak is greater than 1/3 of the previous pitch peak or the search has gone beyond the end of the window (this could happen when the window has been extended) it is assumed that the largest peak in the search window is the corrrect pitch peak as indicated in block 35. The pitch period is assumed equal to the previous value and the location parameters, such as the location of the next pitch peak, are achieved to fit the assumptions. Since nothing has crossed threshold, threshold is set at 1/2 the amplitude of the assumed pitch peak. The window length parameter is also redefined in case it has changed during the search.

It is possible that the present search location (end of window) is beyond where the next expected peak would be located as indicated in block 36. If this is not true, the results are intialized in block 26. If this is true, this peak may be missed altogether. Therefore, when this condition occurs, the second highest peak within the search window is assumed to be a pitch peak if it is within 1.25 milliseconds of the present search location as indicated in block 37. All of the location parameters are recalculated based on this assumption as indicated in block 38. If the present search location is not beyond the expected pitch peak location, and if the second highest peak is not within 1.25 milliseconds of the present search location, the algorithm initializes the maximum peak parameter in block 26 as its final operation.

For any of the paths taken through the algorithm, the final output at the end of a search cycle is the pitch period. The pitch period remains unchanged during a search cycle. Since a search cycle ends with the location of a peak, which in effect determines the instantaneous pitch period, the calculated pitch period tracks the actual pitch period in real time.

The basic operation of the algorithm involves making a series of decisions based on past and present data. The required storage is minimal since only a few parameters need be retained for the required decisions. Therefore, from the view point of hardware implementation the algorithm is far simpler than a frequency domain or correlation approach.

Figure 7:
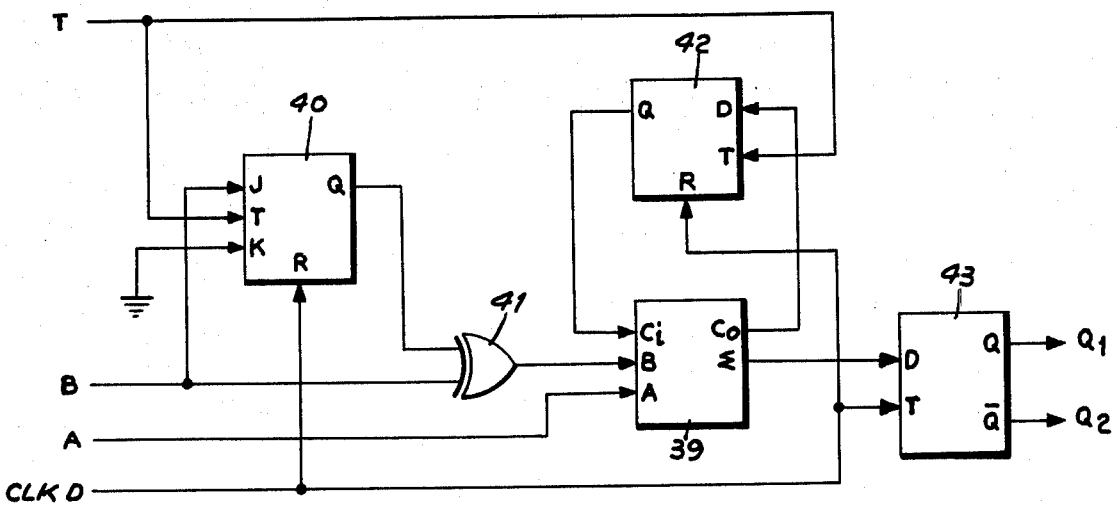
FIG. 7 is a logic diagram of a decision circuit symbolized in FIG. 6 and as employed in FIG. 8.

Referring to FIG. 7, there is illustrated therein the logic circuitry of a decision circuit that will be employed in the logic diagram of FIGS. 8A–8J implementing the algorithm of the present invention. EAch of the decision circuits includes inputs A and B coupled to full adder 39, JK flip-flop 40, and EXCLUSIVE-OR gate 41. The full adder has added thereto a D-type flip-flop 42 to provide a serial adder as employed in the above-cited copending application. The sum output of full adder 39 is coupled to D-type flip-flop 43.

The truth table for this decision circuit is shown hereinbelow in Table II.

TABLE II

| FUNCTION | Q1 | Q2 |
|---|---|---|
| B>A | Yes | No |
| B≤A | No | Yes |

Figure 8K:
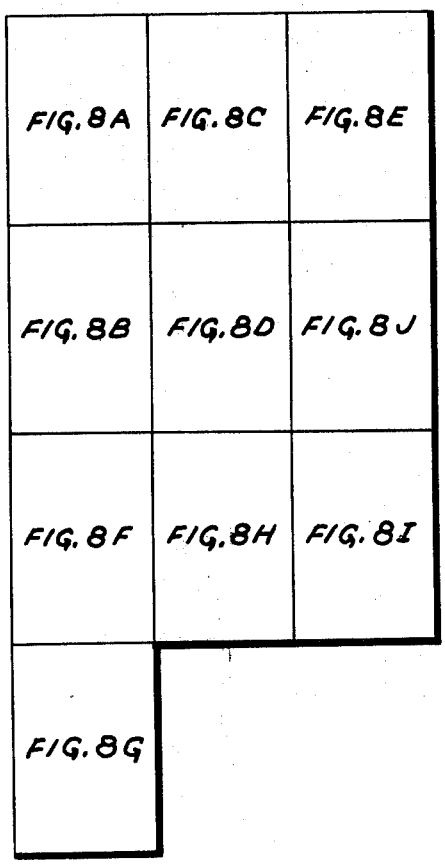
FIGS. 8A through 8J, when organized as illustrated in FIG. 8K, is a logic diagram implementing the algorithm of the present invention.

Referring to FIGS. 8A–8J, when organized as indicated in FIG. 8K, there is disclosed therein the logic diagram that implements the pitch period extraction algorithm of the present invention. The logic diagram includes multiplexers 44–55 associated with shift registers 56–62 and 65–69, as illustrated in FIGS. 8A–8E. THe shift registers perform a dual function. They provide a means for storing the variables and also provide a one sample delay during which the decisions are made. As will be noted, the multiplexers 44–55 have signals applied to their widest side of the rectangular portion of the multiplexer symbol. These are the signal inputs to the multiplexers from various ones of the shift registers 56–62 and 65–69 together with constant values. A select signal or signals are applied to the narrow edge of the rectangular portion of the multiplexer symbols of certain of the multiplexers to select the signals applied to the wide side thereof in accordance with the selecting code illustrated in the rectangular portion of the multiplexer symbol for the coupling of input signals to the shift registers associated therewith and also to the decision circuits which are illustrated in FIGS. 8F–8I. The selecting signals for the multiplexers are derived from the decisions of the decision circuits by the flow logic shown in FIG. 8J, the outputs of which are applied directly or through intermediate gating circuits to the various selecting signal inputs of the multiplexers having selecting inputs.

With the correct data ready to enter each of the registers 56–62 and 65–69, the data is clocked into the shift registers while at the same time being clocked through the decision circuitry. At the end of this cycle, both the input data has been stored in the registers and all the decisions which were set forth in the flow chart have been made. In the idle time following this, the answers from the decisions are transformed through the flow logic of FIG. 8J into the control commands or signal selectors of the multiplexers 44–55. At the start of the next cycle, these multiplexers 44–55 are set to admit the correct new values to the registers 56–62 and 65–69 and the process repeats itself.

There are only two external inputs to the pitch analyzer circuit. One input is the 1-bit decision from the voicing circuit which appears as input V/UV in FIG. 8H. This input is received every sample from the voicing circuit 4 (FIG. 1). The second input is the partially processed speech information referred to as ABSOL which is the output of filter 12. This signal is illustrated in FIG. 8B and is a 32-bit data word received serially on a sample by sample basis every 125 microseconds. Shift registers 63 and 64 are provided to store the two previous samples. At the same time that the pitch analyzer is receiving the 12th bit of ABSOL, the first bits of signals INRP and IPRP, the pitch period from the previous sample and the pitch period from two samples ago, respectively, are being fed to the pitch correction circuit of the above-cited copending application from shift register 69 (FIG. 8E). Both of these signals are 13-bit data words which represent the integer number of samples from one to the next pitch peak and, therefore, the pitch period. A third signal NUMRAT, a 32-bit serial word is also available at the output of multiplexer 54 (FIG. 8E) and is sent to the voicing decision circuit 4 (FIG. 1). As the first bit of ABSOL is being clocked into the pitch analyzer, the first bit of NUMRAT is clocked into the voicing decision circuit 4 (FIG. 1).

The pitch period output NSPER is obtained from shift register 69 (FIG. 8E).

The total time needed to cycle through the decisions is 32 clock periods. Pitch period analysis is carried out during every sample period of 125 microseconds.

The decision circuits illustrated in FIGS. 8F–8I will now be correlated with the decisions contained in the diamond-shaped blocks of the flow chart of FIGS. 4A and 4B. The letter reference characters in parentheses in FIGS. 8F–8I refer to the letter reference characters of the diamond-shaped blocks of FIGS. 4A and 4B to enable a correlation of the components of FIGS. 8F–8I with the diamond-shaped blocks of FIGS. 4A and 4B.

The decision for the diamond-shaped block A of the flow chart is performed by decision circuit 70 with the D1 decision being coupled to a D-type flip-flop 71 to provide the second decision as indicated in the diamond-shaped block B of the flow chart.

The decision of the diamond-shaped block C of the flow chart is carried out by decision circuit 72.

The decision specified in diamond-shaped block D of the flow chart is performed by decision circuit 73 and the decision set forth in diamond-shaped block E is carried out by decision circuit 74.

The decision specified in diamond-shaped block F of the flow chart is carried out by decision circuits 75 and 76, OR gate 77 and AND gates **77*a* and 77*b***.

The decision set forth in the diamond-shaped block G of the flow chart is carried out by JK flip-flop 78, EXCLUSIVE-OR gate 79, full adder 80, D-type flip-flop 81, decision circuits 82 and 83 and AND gate 84.

The decision set forth in diamond-shaped block H of the flow chart is carried out by D-type flip-flops 85 and 86, serial adders including D-type flip-flops 87 and 88 and full adders 89 and 90, decision circuits 91 and 92, AND gate 93, INHIBIT gate 94, OR gate 95 and NOT gate 95'.

THe decision specified in the diamond-shaped block I of the flow chart is carried out by the full adder including D-type flip-flop 96 and full adder 97, decision circuit 98, AND gate 99, INHIBIT gate 100, AND gate 101 receiving inputs from the flow logic of FIG. 8J and OR gate 102.

The decision indicated in the diamond-shaped block J of the flow chart is carried out by decision circuits 103–106, OR gates 107 and 108, multiplexer 109 receiving selection inputs from the flow logic of FIG. 8J and NOT gate 110.

The decision set forth in the diamond-shaped block K of the flow chart is performed by D-type flip-flops 111-113, JK flip-flop 114, EXCLUSIVE-OR gate 115, serial adder including D-type flip-flop 116 and full adder 117, decision circuits 118 and 119, OR gate 120, NOT gate 121 and AND gates 121*a* and 121*b*.

The decision set forth in the diamond-shaped block L of the flow chart is provided by D-type flip-flop 122 operating on the V/UV input to the pitch period analyzer.

A 13th decision identified as D13 is provided by JK flip-flop 123, EXCLUSIVE-OR gate 124, the serial adder including D-type flip-flop 125, and full adder 126 and D-type flip-flop 127. This decision signal is sent to multiplexers 128 and 129 whose outputs are coupled to JK flip-flop 130, EXCLUSIVE-OR gate 131 and two serial adders, one of which includes D-type flip-flop 132 and full adder 133 and the other of which includes D-type flip-flop 134 and full adder 135. The output of full adder 135 is coupled to one of the signal inputs of multiplexer 52 which provides a DLPER output which cooperates in providing the decision in diamond-shaped block G of the flow chart. Thus, the 13th decision D13 is used to control the production of 7th decision signal G-D7 and E-D7.

While we have described above the principles of our invention in connection with specific apparatus it is to be clearly understood that this description is made only by way of example and not as a limitation to the scope of our invention as set forth in the objects thereof and in the accompanying claims.

We claim:

1. A digital pitch period extraction circuit for a digital vocoder having a digital adaptive filter providing a multiple fit digital prediction residual for each sample, said extraction circuit comprising:

a squarer coupled to said adaptive filter to square said residual;

a digital low pass filter coupled to said squarer to low pass filter said squared residual; and logic circuitry coupled to said low pass filter to locate sharp pitch peaks in the output signal of said low pass filter and to determine the time separation between two adjacent pitch peaks to provide therefrom an output signal equal to the pitch period, said circuitry having a time moving search window and a time varying amplitude threshold level to locate said pitch peaks.

2. An extraction circuit according to claim 1, wherein said squarer includes a multiplier to multiply said residual by itself.

3. An extraction circuit according to claim 1, wherein said low pass filter includes a first divider coupled to said squarer to divide said squared residual by a first given factor, N delay registers coupled in cascade with respect to each other and said first divider, where N is an integer greater than two, a first adder coupled to each of said N registers, (N-1) delay registers coupled in cascade with respect to each other and said first adder, a second adder coupled to each of said (N-1) registers, (N-2) delay registers coupled in cascade with respect to each other and said second adder, a third adder coupled to each of said (N-2) registers, and a second divider coupled to said third adder, said second divider to divide the output signal of said third adder by a second given factor less than said first given factor.

4. An extraction circuit according to claim 3, wherein said squarer includes a multiplier to multiply said residual by itself.

5. An extraction circuit according to claim 1, wherein said circuitry includes at least one shift register coupled to said adaptive filter to receive said residual, a plurality of other shift registers, a plurality of decision circuits coupled to said one shift register and said plurality of other shift registers, a plurality of multiplexers each to control feeding input signals from predetermined ones of said plurality of other shift registers to still other predetermined ones of said plurality of other shift registers and certain selected ones of said plurality of decision circuits to provide a decision signal from each of said plurality of decision circuits, flow logic coupled between said plurality of decision circuits, said plurality of other shift registers and a selected one of said plurality of decision circuits to control said selected one of said plurality of decision circuits and to control associated ones of said plurality of multiplexers by associated ones of said decision signal to enable each of said plurality of multiplexers to feed said input signals applied thereto to the appropriate ones of said plurality of other shift registers and certain selected ones of said plurality of decision circuits.

6. An extraction circuit according to claim 5, further including a voiced/unvoiced control signal coupled to a certain one of said plurality of decision circuits.

7. An extraction circuit according to claim 6, wherein said squarer includes a multiplier to multiply said residual by itself.

8. An extraction circuit according to claim 7, wherein said low pass filter includes a first divider coupled to said squarer to divide said squared residual by a first given factor, N delay registers coupled in cascade with respect to each other and said first divider, where N is an integer greater than two, a first adder coupled to each of said N registers, (N-1) delay registers coupled in cascade with respect to each other and said first adder, a second adder coupled to each of said (N-1) registers, (N-2) delay registers coupled in cascade with respect to each other and said second adder, a third adder coupled to each of said (N-2) registers, and a second divider coupled to said third adder, said second divider to divide the output signal of said third adder by a second given factor less than said first given factor.

9. An extraction circuit according to claim 6, wherein said low pass filter includes a first divider coupled to said squarer to divide said squared residual by a first given factor, N delay registers coupled in cascade with respect to each other and said first divider, where N is an integer greater than two, a first adder coupled to each of said N registers, (N-1) delay registers coupled in cascade with respect to each other and said first adder, a second adder coupled to each of said (N-1) registers, (N-2) delay registers coupled in cascade with respect to each other and said second adder, a third adder coupled to each of said (N-2) registers, and a second divider coupled to said third adder, said second divider to divide the output signal of said third adder by a second given factor less than said first given factor.

10. An extraction circuit according to claim 1, wherein said circuitry includes first means to locate said peaks, second means coupled to said first means to determine if said located peaks crosses said threshold, a first decision path coupled to said second means if said located peaks do cross said threshold, a second decision path coupled to said second means if said located peaks do not cross said threshold, and an output circuit coupled to said first and second paths to provide said output signal.

11. An extraction circuit according to claim 10, wherein said first path includes third means coupled to a "yes" output of said second means to determine if the present one of said located peaks that crossed said threshold is more than 2.5 milliseconds spaced from an immediate previous one of said located peaks that crossed said threshold, said third means providing an output to said output circuit if the above statement is found to not be true, fourth means coupled to a "yes" output of said third means to calculate said pitch period and to set the length of said search window, fifth means coupled to said fourth means to determine if said pitch period calculated in said fourth means has dropped by more than 3/5 of an immediately previous calculated pitch period, sixth means coupled to a "yes" output of said fifth means to determine if speech is voiced or unvoiced, seventh means coupled to a "no" output of said fifth means an "unvoiced" output of said sixth means and said output circuit to calculate location parameters and said threshold level, and eighth means coupled to a "voiced" output of said sixth means and said output circuit to set said pitch period equal to the previous value of said pitch period and to calculate location parameters.

12. An excitation circuit according to claim 11, wherein said second path includes ninth means coupled to said first means to determine the amplitude and location of the largest of said located peaks in said search window, tenth means coupled to said first means to determine the amplitude and location of the second largest of said located peaks in said search window, eleventh means coupled to a "no" output of said second means to determine present search location with respect to an end of said search window, said eleventh means having a first out indicating that the present search location is at said end of said search window, a second output indicating that the present search location is beyond said end of said search window and a third output indicating that the present search location is before said end of said search window, said third output being coupled to said output circuit, twelfth means coupled to said ninth means to determine if amplitude of largest of said located peaks within said search window is less than 1/3 of the amplitude of the immediately previous of said located peaks that crossed said threshold, thirteenth means coupled to said second output of said eleventh means and a "no" output of said twelth means to assume that the largest of said located peaks in said search window is pitch peak, to set said pitch period to the previous value and to set search window length and location parameters, fourteenth means coupled to a "yes" output of said twelfth means and said output circuit to extend the length of said search window;

fifteenth means coupled to said thirteenth means and having a "no" output coupled to said output circuit to determine if the present location is beyond the location of the next pitch peak, sixteenth means coupled to a "yes" output of said fifteenth means and said tenth means, said sixteenth means having a "no" output coupled to said output circuit, said sixteenth means determining if the second highest peak in said search window is within 1.25 milliseconds of the present location, and seventeenth means coupled to a "yes" output of said sixteenth means and said output circuit to redefine the location parameters.

* * * * *